US006705239B2

(12) United States Patent
Doyle

(10) Patent No.: US 6,705,239 B2
(45) Date of Patent: Mar. 16, 2004

(54) ADJUSTABLE TABLE ASSEMBLY

(75) Inventor: James E. Doyle, Grandville, MI (US)

(73) Assignee: Suspa Incorporated, Grand Rapids, MI (US)

( * ) Notice: Subject to any disclaimer, the term of this patent is extended or adjusted under 35 U.S.C. 154(b) by 0 days.

(21) Appl. No.: 10/218,650

(22) Filed: Aug. 14, 2002

(65) Prior Publication Data

US 2003/0033963 A1 Feb. 20, 2003

Related U.S. Application Data

(60) Provisional application No. 60/313,229, filed on Aug. 17, 2001.

(51) Int. Cl.[7] ..... A47B 9/00
(52) U.S. Cl. ..... 108/147
(58) Field of Search ..... 108/147, 144.11, 108/147.19, 150; 248/188.2, 188.5, 188.7, 188.8

(56) References Cited

U.S. PATENT DOCUMENTS

| | | | | | |
|---|---|---|---|---|---|
| 2,388,056 | A | * | 10/1945 | Hendricks | 108/147 |
| 2,499,005 | A | * | 2/1950 | Sellers | 108/147 |
| 3,117,392 | A | * | 1/1964 | Junkunc | 108/147.19 |
| 4,493,469 | A | * | 1/1985 | Holobaugh | 108/147 |
| 4,711,184 | A | | 12/1987 | Wallin et al. | |
| 5,050,829 | A | | 9/1991 | Sykes | |
| 5,285,733 | A | | 2/1994 | Waibel | |
| 5,553,550 | A | | 9/1996 | Doyle | |
| 5,890,438 | A | * | 4/1999 | Frankish | 108/147 |
| 6,302,280 | B1 | | 10/2001 | Bermes | |
| 6,360,675 | B1 | | 3/2002 | Jones | |
| 6,474,246 | B2 | * | 11/2002 | Hsu | 108/147 |
| 6,484,648 | B1 | * | 11/2002 | Long | 108/147 |

FOREIGN PATENT DOCUMENTS

GB 2160768 * 6/1985

OTHER PUBLICATIONS

U.S. Patent Publication No. 2002/0074477 A1 entitled Motor Mount, published Jun. 20, 2002.
One sheet of table sketches.
Bosch Aluminum Structural Framing System brochure, Version 2.0, cover and pp. 9–6 and 12–7.

* cited by examiner

*Primary Examiner*—Jose V. Chen
(74) *Attorney, Agent, or Firm*—Price, Heneveld, Cooper, DeWitt & Litton

(57) ABSTRACT

A table assembly has extruded motorized telescopic legs with an outer leg including adjustable feet which provide micro adjustment of the height of the table assembly. The combination of the telescopic support leg and adjustable feet provide macro and micro adjustment of the table to accommodate workers of different stature.

24 Claims, 9 Drawing Sheets

ADJUSTABLE TABLE ASSEMBLY

CROSS-REFERENCE TO RELATED APPLICATIONS

This application claims priority under 35 U.S.C. §119(e) on U.S. Provisional Application No. 60/313,229 entitled ADJUSTABLE TABLE ASSEMBLY, filed on Aug. 17, 2001, by James E. Doyle, the entire disclosure of which is incorporated herein by reference.

BACKGROUND OF THE INVENTION

The present invention relates to an adjustable table and particularly to a table leg assembly which allows macro and micro adjustment of the height of the table work surface.

In current ergonomic work spaces, it is desirable to provide personnel with work areas which accommodate different working positions, either sitting or standing, and for personnel of different heights. It has been discovered that work surface heights of about 22" to 24" from the floor is appropriate for female workers when seated, while approximately 24" to 28" from the floor is an average comfortable height for male workers. On the other hand, in a standing position, work surface heights of from about 37" to 42" for female workers and about 39" to 46" for male workers are desirable. Thus, to accommodate both male and female workers in sitting and standing positions, a relatively large range of motion (i.e., 22" to 46") is desirable for a given work surface. Several proposals have been made for providing multiple leg telescopic actuators, such as described in U.S. patent application Ser. No. 09/573,065 filed May 17, 2000, entitled ADJUSTABLE LEG ASSEMBLY, and U.S. patent application Ser. No. 09/901,225 filed Jul. 9, 2001, entitled TELESCOPIC LINEAR ACTUATOR, the disclosures of which are incorporated herein by reference. The use of multiple telescopic legs using two or more interactive telescopic sections satisfies the desired height adjustment requirement, however, such telescopic legs can be somewhat expensive to manufacture insofar as they require additional parts and assembly procedures. Conventional single stage screw-type actuators are capable of providing 24" of adjustment, however, mechanical restrictions in the design of telescoping guide mechanisms make it impossible to achieve the specified seated heights within this range of motion. The range of work surface heights should cater to the intended user rather than an entire population of users.

As a result, there remains a need for an adjustable work surface which allows a range of motion for male and female workers between standing and sitting positions and which is inexpensive to manufacture and utilizes a single screw actuating mechanism.

SUMMARY OF THE INVENTION

The table assembly of the present invention satisfies this need by providing at least one telescopic leg assembly, which is motor-actuated. The leg assembly has an outer leg with adjustable feet to provide micro adjustment of the height of the work surface. The combination of a telescopic support leg and adjustable feet thus provides macro and micro adjustment of the table leg and provide additional height adjustment to accommodate workers of different stature. Preferably, the leg assembly includes extruded leg members with an extruded track formed in an outer leg which receives the adjustable feet and can also accommodate cross-struts for providing additional support to the table.

These and other features, objects and advantages of the present invention will become apparent upon reading the following description thereof together with reference to the accompanying drawings.

DETAILED DESCRIPTION OF THE PREFERRED EMBODIMENT

Figure 1:
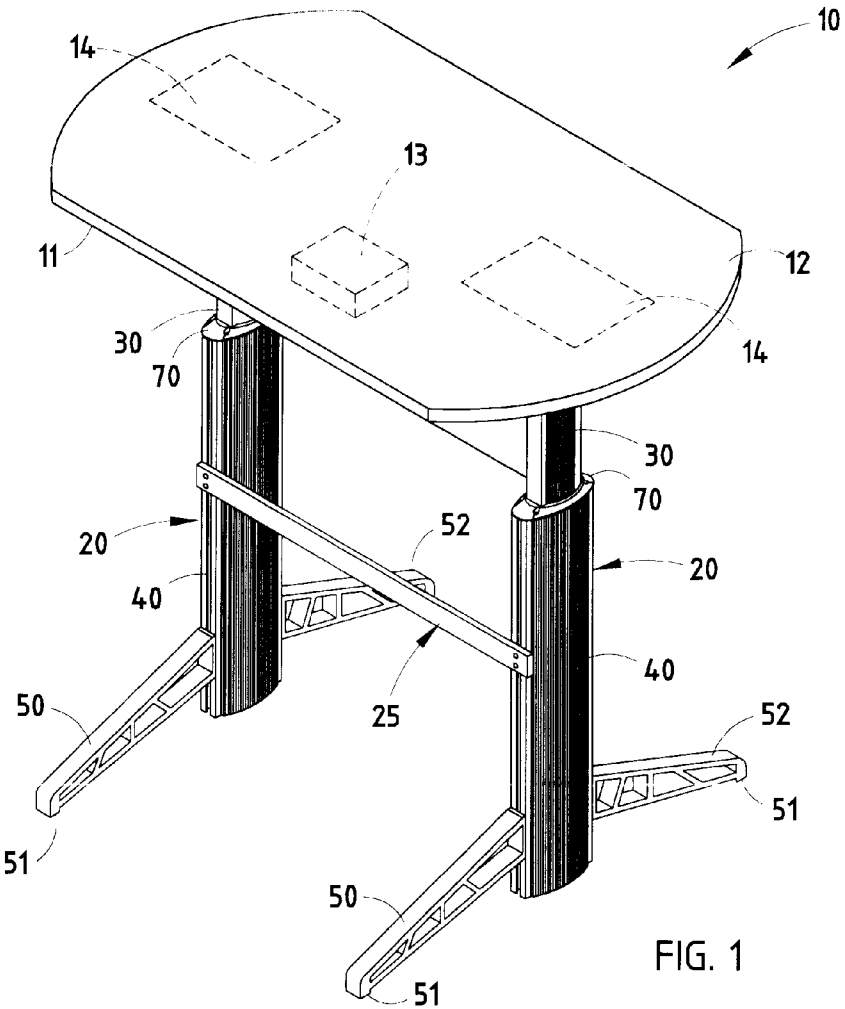
FIG. 1 is a perspective view of a table assembly embodying the present invention.
Figure 2B:
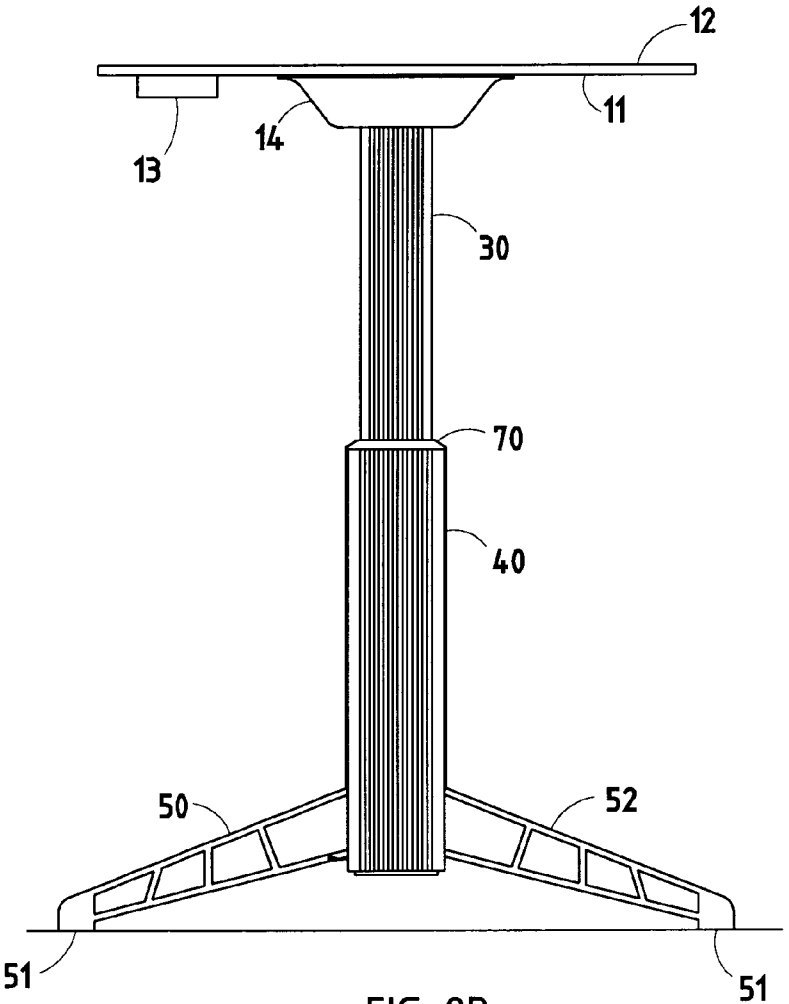
FIG. 2B is a side elevational view of one of the leg assemblies shown with the feet in a position to raise the table to a maximum height.
Figure 2A:
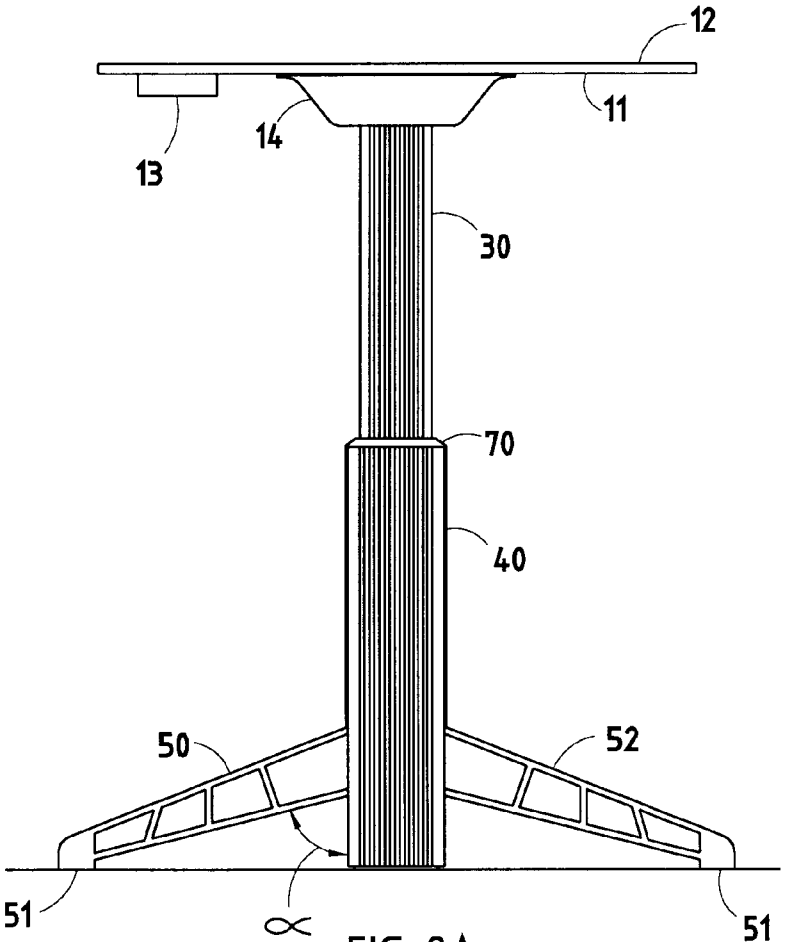
FIG. 2A is an end elevational view of one of the leg assemblies for the table assembly, shown with the feet in a position for lowering the overall height of the table.
Figure 3:
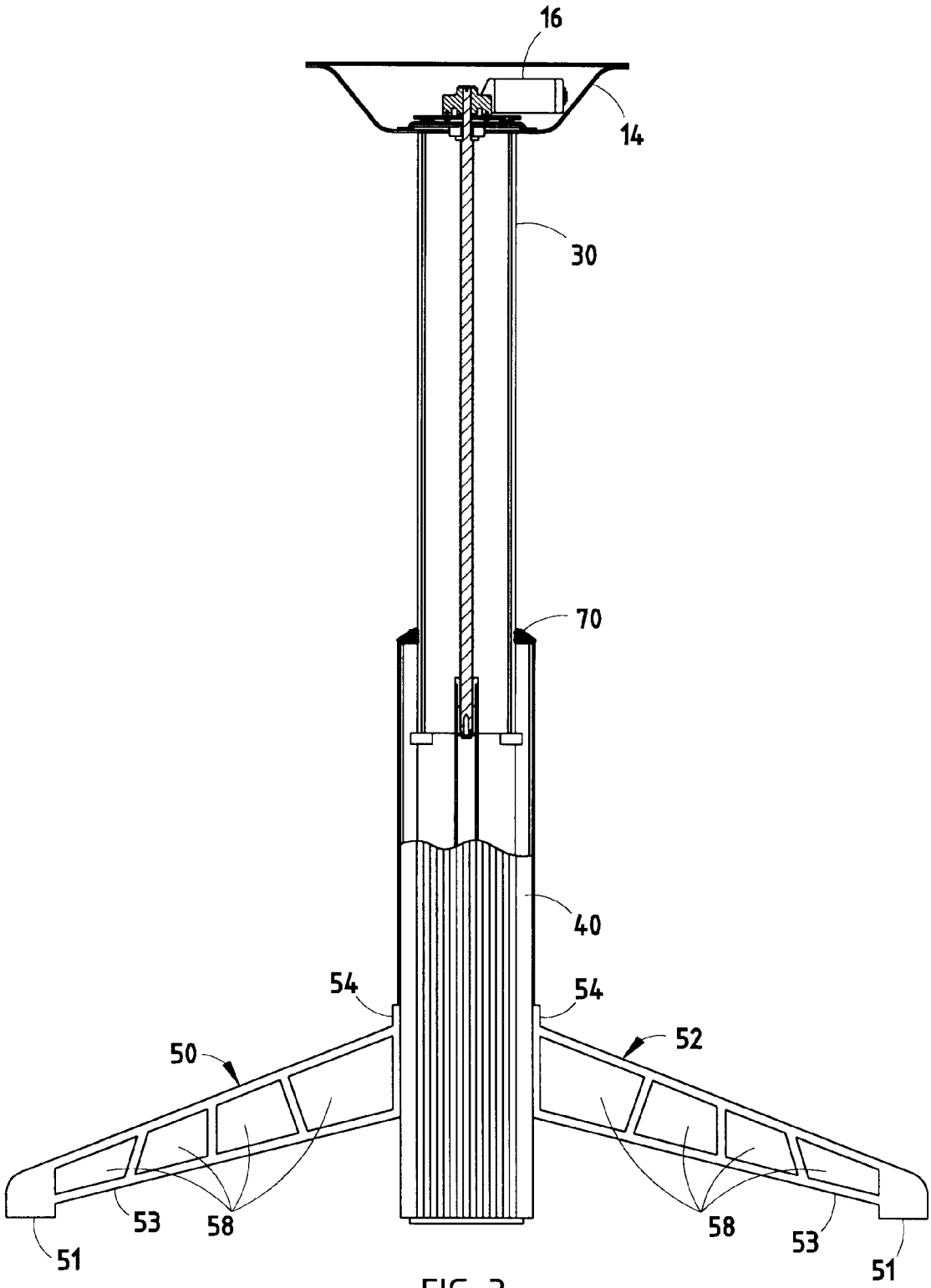
FIG. 3 is an enlarged partial vertical cross-sectional view through one of the leg assemblies.

Referring initially to FIGS. 1, 2A, and 2B, there is shown a table assembly 10 embodying the present invention. Assembly 10 includes a generally planar work surface or table top 12 coupled to a pair of substantially identical adjustable leg assemblies 20. Each of the identical leg assemblies 20 includes an inner leg 30 telescopically extending with an outer leg 40 and a pair of adjustable feet 50, 52, which allow the table to move from an adjustable lowered position approximately 24" to 28" high for the work surface 12 to an adjustable raised position approximately 40" to 44" in height in the raised position, as illustrated in FIGS. 2A and 2B, respectively. The inner and outer legs, as described below, are telescopically mounted with respect to one another and movable utilizing a motorized screw jack assembly to provide macro adjustment of approximately 16" between the lowermost position and an uppermost or raised position. The feet 50, 52 can be adjusted along the outer leg 40 as shown in FIGS. 2A and 2B to provide micro adjustment of approximately 4" between a lower position, shown in FIG. 2A, and an upper position, shown in FIG. 2B, as described below. Thus, the table assembly 10 has the ability to provide motor-driven adjustment between selected first and second raised and first and second lowered positions, depending on the position of the adjustable feet 50, 52 on the outer leg 40. Inner legs 30 are mounted to the undersurface 11 of work surface 12 by means of a motor enclosure 14. A motor control 13 is coupled to a supply of operating power (not shown) and selectively applies electrical power to a reversible DC electric motor 16 (FIGS. 3 and 4) in each of the leg assemblies 20 to provide macro adjustment of the work surface 12 over a range of about 16".

Figure 4:
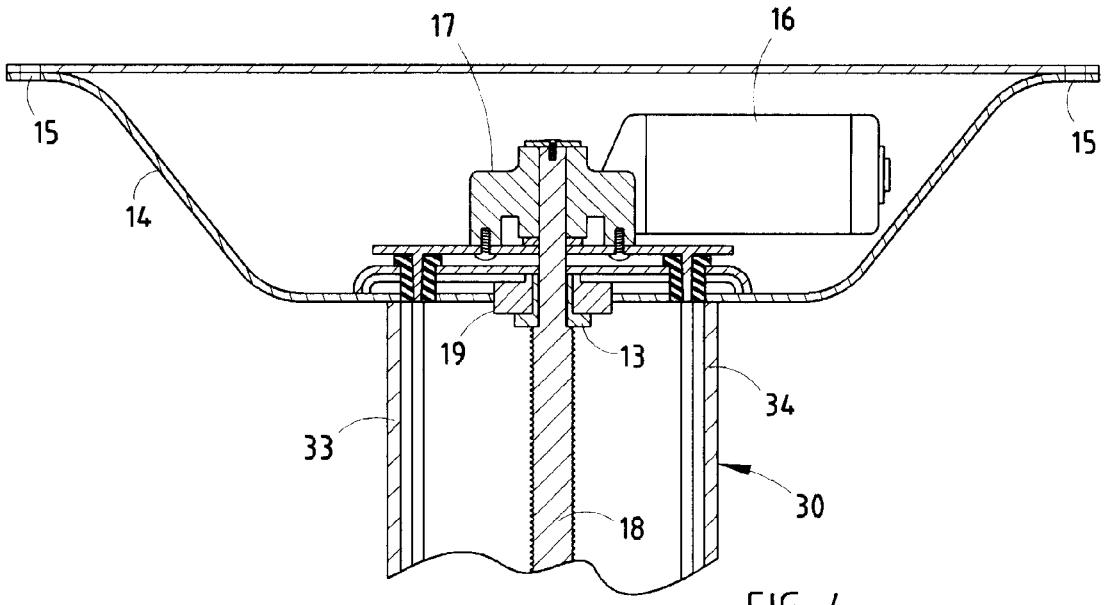
FIG. 4 is an enlarged cross-sectional view of the upper end of the leg assembly shown in FIG. 3.
Figure 5:
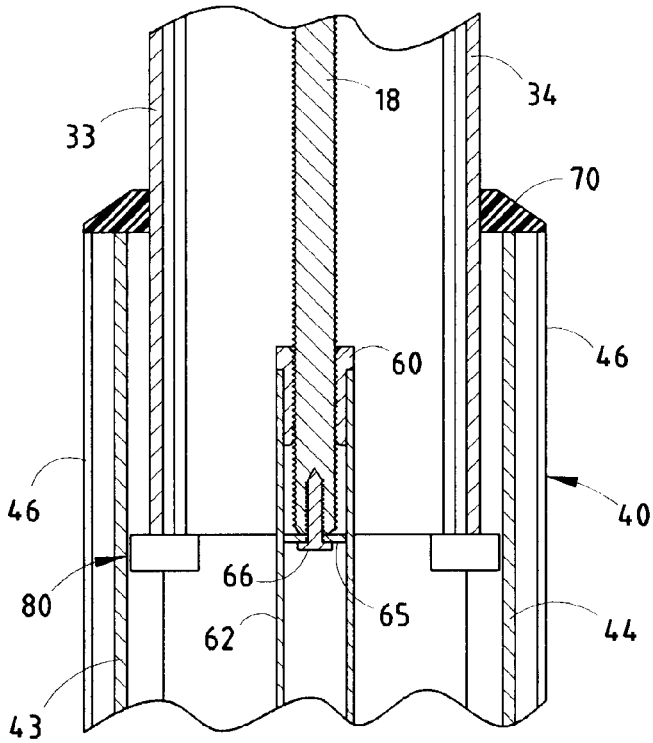
FIG. 5 is an enlarged vertical cross-sectional view of the interface between the upper leg and lower leg of the leg assembly, taken along section line V—V of FIG. 6.
Figure 8:
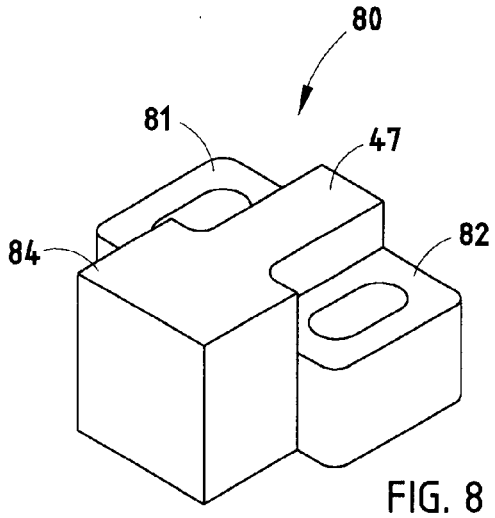
FIG. 8 is a perspective view of one of the guides employed for slidably supporting the inner leg with respect to the outer leg.
Figure 9:
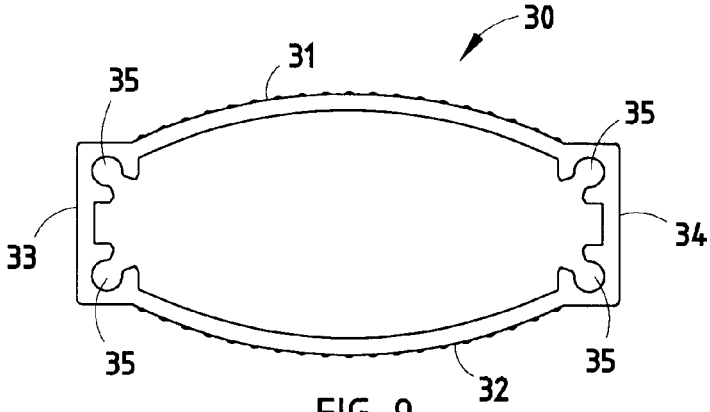
FIG. 9 is a horizontal cross-sectional view of the inner leg extrusions.
Figure 10:
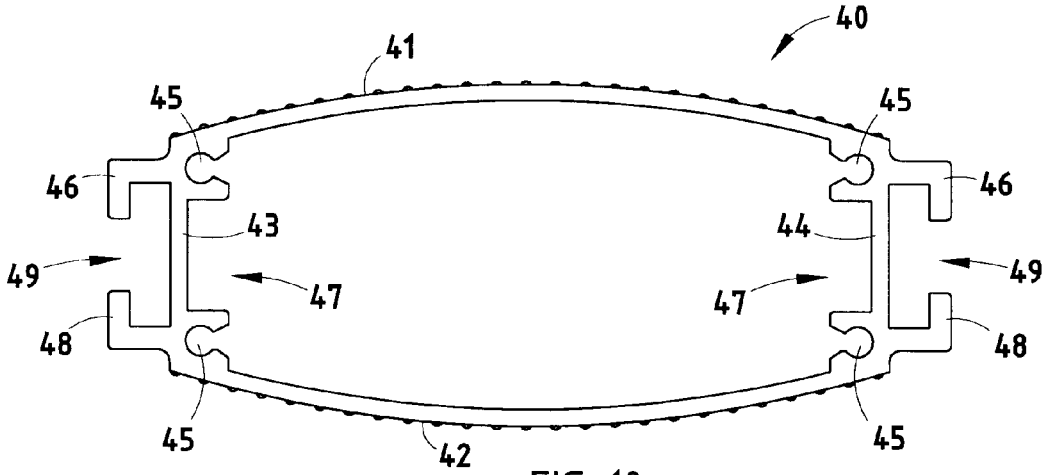
FIG. 10 is a horizontal cross-sectional view of the outer leg extrusion.

The inner and outer legs 30, 40, respectively, are shown in horizontal cross-sectional detail in FIGS. 9 and 10 and are extruded of a suitable material, such as aluminum, which can be anodized, plated, or painted to provide a desired appearance. The inner leg 30 has a generally ovular/rectangular cross section with convexly curved side walls 31 and 32 and flattened end walls 33 and 34. At the inner junction of the side and end walls, there are formed sockets 35 at the four corners for receiving self-threading screws (not shown) for the attachment of slides 80 (FIGS. 7 and 8) to the bottom of inner leg 30, as seen in FIG. 5, and the top of inner leg 30 to the motor enclosure, as best seen in FIG. 4.

Figure 6:
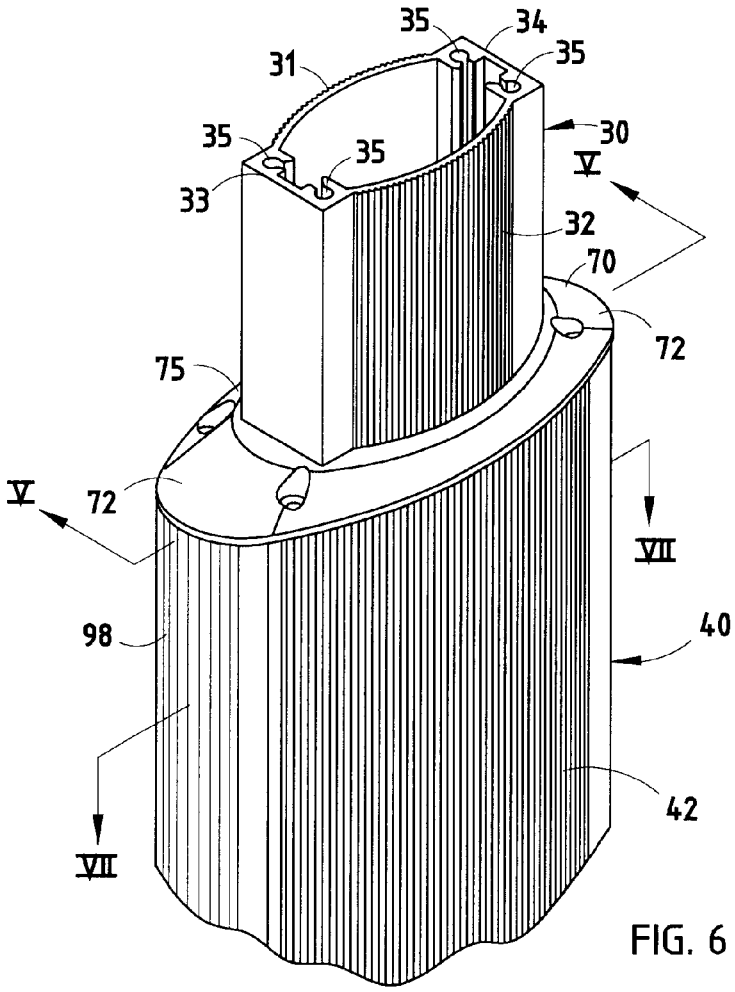
FIG. 6 is a fragmentary perspective view of the interface shown in FIG. 5.
Figure 12:
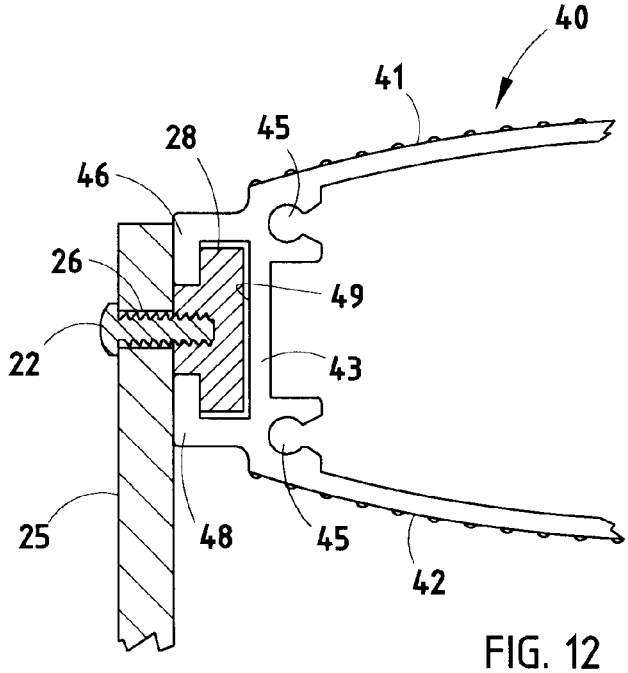
FIG. 12 is a fragmentary cross-sectional view taken through section lines XII—XII of FIG. 11.
Figure 13:
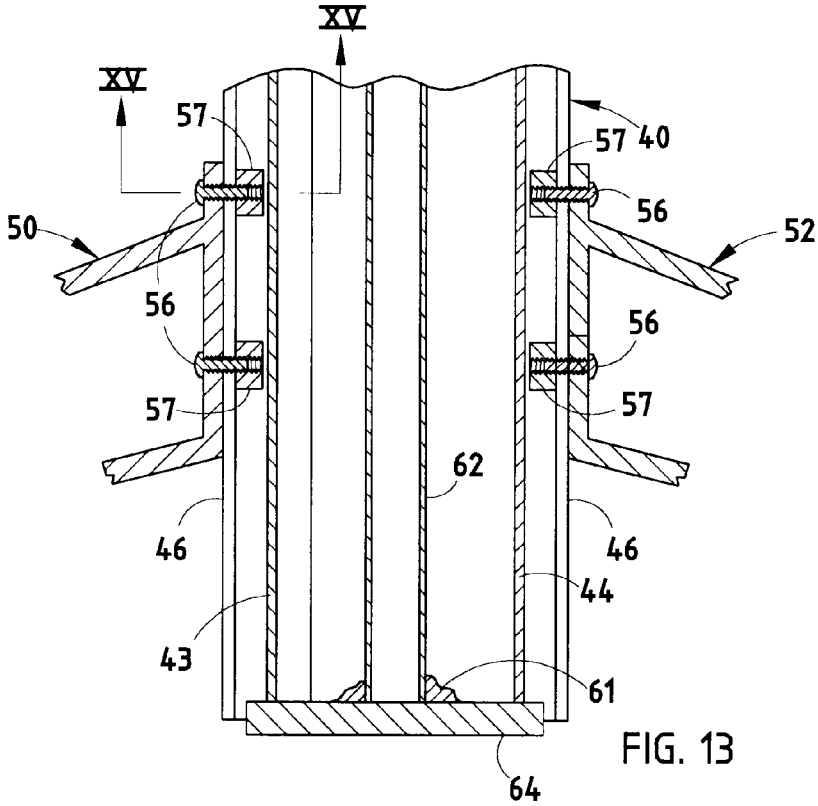
FIG. 13 is a fragmentary enlarged vertical cross sectional view of the foot area of one of the leg assemblies shown in FIGS. 1, 2A, 2B and 3.

The outer leg 40 also is an extruded member having a somewhat flattened ovular/rectangular cross section with side walls 41 and 42 and end walls 43 and 44, with the intersection thereof including screw-receiving sockets 45 at the junction of the side and end walls for receiving mounting screws for securing the base 64, as seen in FIG. 13 and described below, and bezel 70 (FIG. 6). Integrally formed with outer walls 43, 44 are L-shaped opposed facing legs 46 and 48 external to each of the end walls 43, 44 to define T-shaped slots 49 which, as described in greater detail below, adjustably receives T-nuts for mounting the feet 50, 52 as well as a stretcher 25, which extends between each of the leg assemblies 20 to the outer legs 40, as shown in FIGS. 1 and 11–14.

Figure 11:
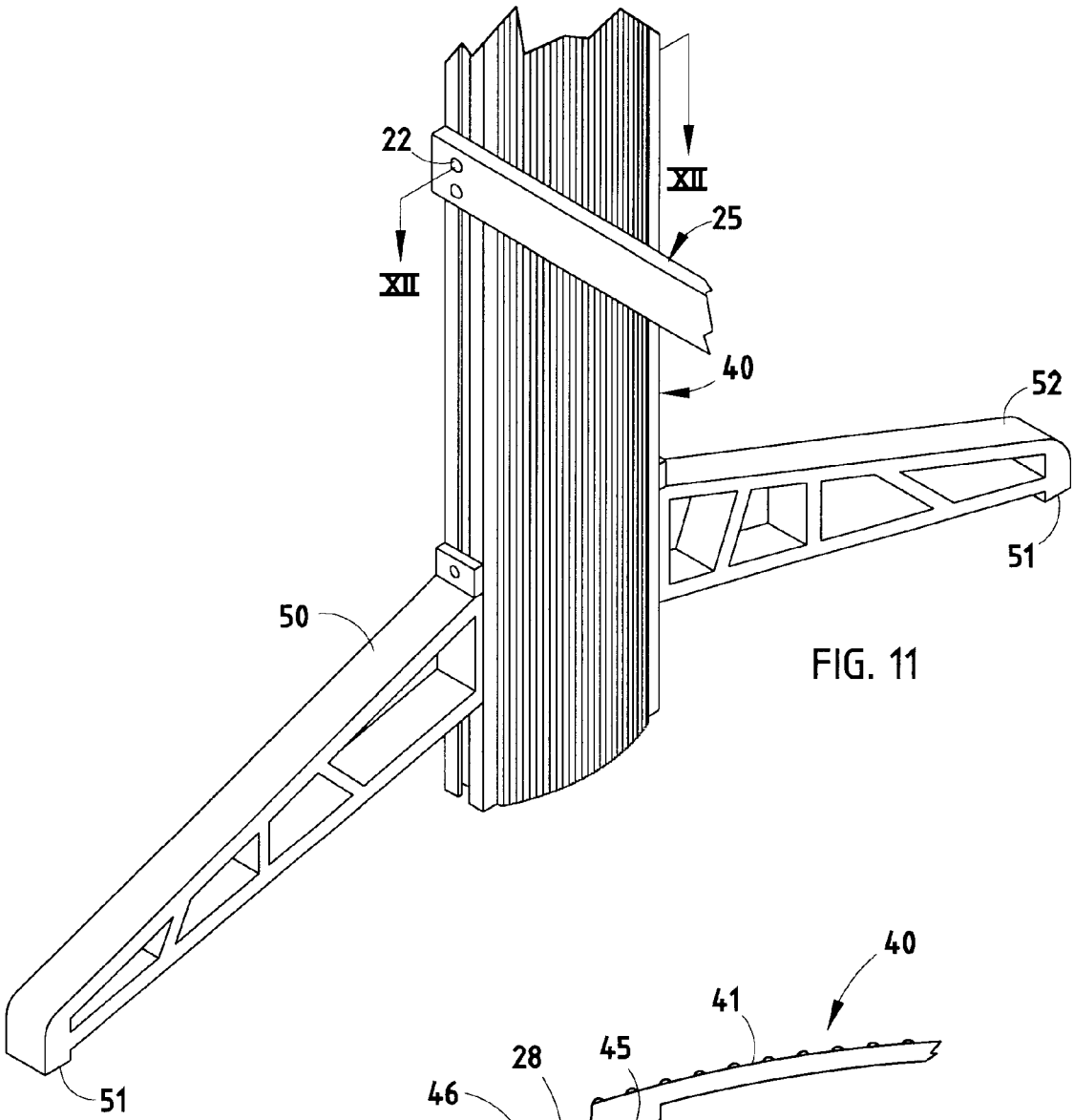
FIG. 11 is a fragmentary perspective view of a stretcher employed for coupling the leg assemblies.

As seen in FIGS. 11 and 12, the stretcher 25 includes a pair of spaced apertures 26 at each end for receiving threaded fasteners, such as bolts 22, which extends through the aperture and stretcher 25 to a T-shaped nut 28 fitted within T-shaped slot 49 of the outer leg 40 for securing each end of stretcher 25 to the outer leg. As seen in FIG. 11, two such fasteners 22 and associated T-shaped nuts 28 may be employed at each end of the stretcher. The stretcher provides lateral stability to the table assembly, as seen in FIG. 1, and typically will be placed near the upper end of outer leg 40. Additional stretchers may be employed and one may be placed at the lower end of the table at the feet 50, 52 to provide a foot rest for the table assembly, if desired. Additionally, a stretcher may be placed on both the front and rear end walls 43, 44 of the outer leg 40, if desired. Before describing the micro adjustment of the feet 50, 52 along the T-shaped slot 49 defining elongated, vertically extending tracks in the outer leg 40, a description of the motorized telescopic mounting of the inner leg 30 to the outer leg 40 is described in connection with FIGS. 3–8.

Each of the leg assemblies 20 are substantially identical, therefore, a description of only one of the leg assemblies follows. The leg assemblies 20 are coupled to work surface 12, as noted below, by motor enclosure 14, which includes apertures 15 (FIG. 4) for receiving fasteners which attach the motor enclosure 14 to the lower surface 11 of the table top defining work surface 12. Motor enclosure 14 defines an open housing for receiving a drive motor 16 having an angled gear box 17 keyed to a threaded power screw 18 which extends through a collar 13 at the top of the power screw and a thrust bearing 19. Motor enclosure 14 is secured to the open, upper end of the inner leg 30 and includes an aperture for receiving the collar and thrust bearing such that, upon actuation of motor 16, the power screw 18 rotates for raising and lowering the inner leg 30 with respect to the outer leg 40.

The power screw 18 is coupled, as best seen in FIG. 5, to an internally threaded power nut 60 secured to a riser tube 62, which is concentric with and extends upwardly from the base plate 64 (FIG. 13) secured to outer leg 40. Tube 62 is welded at 61 to the lower mounting plate 64 which rests on the support surface or floor at which the table assembly 10 is located. The power screw is secured to a guide washer 65 (FIG. 5) by means of a threaded fastener 66 to control the motion of the power screw as it slidably extends within riser tube 62. Thus, rotation of the power screw 18 by activation of motor 16, which is supplied by suitable electrical power from control 13 to provide reverse polarity activation of the reversible DC electrical motor in a conventional manner, causes the power screw to raise and lower, carrying with it the inner leg 30 attached at its upper end to the mounting bracket 14 and, therefore, work surface 12.

The lower end of inner leg 30 is guidably supported at the upper end of the outer leg 40 by means of a guide bezel 70 (FIG. 6), which has four apertures 72 in each of the corners for receiving fastening screws extending into apertures 45 in outer leg 40. Bezel 70 includes a central opening 75 generally conforming to the outer peripheral shape of inner leg 30, thereby providing stability to the inner leg at the interface of outer and inner legs, as seen in FIG. 6. The lower end of inner leg 30 is supported within the internal U-shaped channels 47 (FIGS. 7 and 10) of outer leg 40 by means of a pair of lubricious polymeric slides 80 with one such identical slide 80 being shown in detail in FIG. 8. Each of the slides 80 comprises a generally rectangular block of polymeric material, such as acetal, polyvinyl chloride, ABS, or the like, and has a pair of elongated apertures 81, 82 for receiving fastening screws extending through apertures 81, 82 into apertures 35 on inner leg 30. Slides 80 include a rectangular outwardly extending projection 84 which fits within guide channels 47 with the elongated apertures 81, 82 allowing for appropriate adjustment of the slides 80 with respect to the inner contacting surfaces of channels 47 of outer leg 40. Thus, the lower end of inner leg 30 is supported by a pair of lubricious slides 80 as it moves within outer leg 40 while the junction of the inner and outer legs 30 and 40 is also supported by the guide bezel 70.

Figure 14:
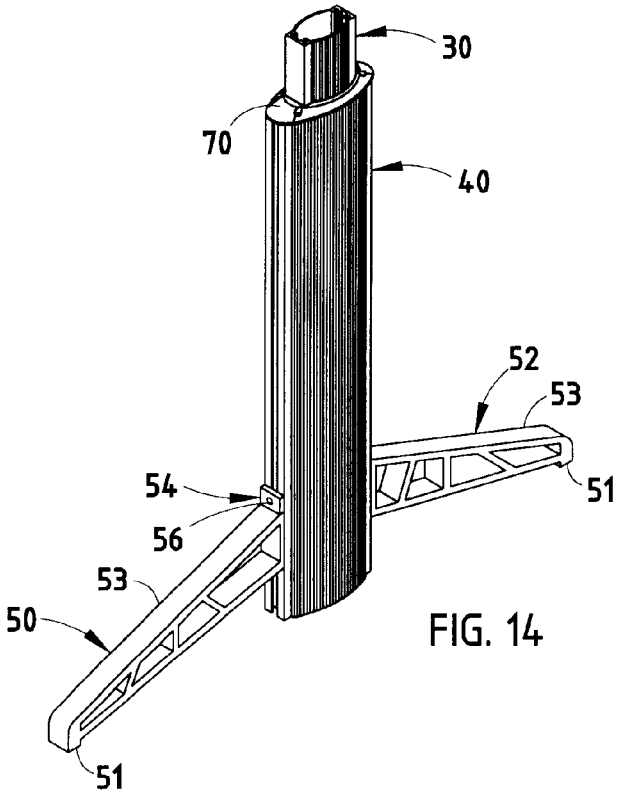
FIG. 14 is a fragmentary perspective view of the foot area of the leg assembly shown in FIGS. 1, 2A, 2B and 3.
Figure 15:
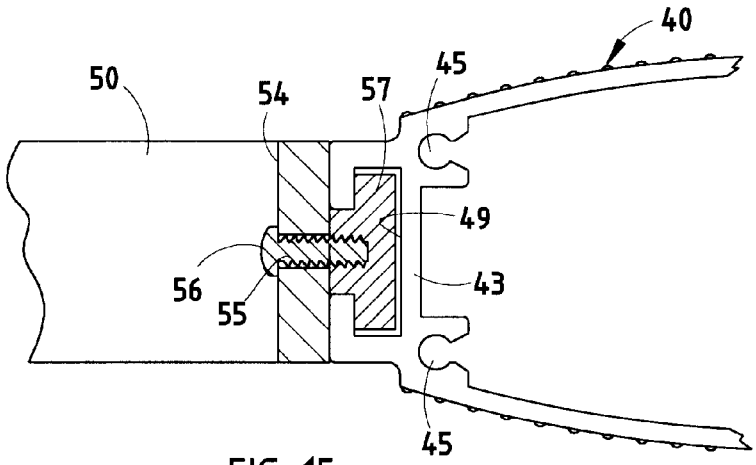
FIG. 15 is an enlarged fragmentary cross-sectional view of one of the feet shown in FIG. 14, taken along section lines XV—XV in FIG. 14.

The lower end of each of the outer legs 40 is supported on the floor of the installation supporting the table by means of the pair of feet 50, 52, shown in FIGS. 1, 2A, 2B and 3, and which are attached as best seen in FIGS. 14 and 15 now described. Feet 50, 52 are substantially identical and each includes floor engaging pad 51 which has a generally horizontal extending surface and upwardly inclined leg 53 and an attachment end 54, which has a vertically extending surface having flanges with apertures 55 (FIG. 15) for receiving attaching bolts 56 which extend through apertures 55 and thread into a T-nut 57 in slots 49 in outer leg 40 to allow the adjustment of each of the feet 50, 52, as seen in FIGS. 2A and 2B, by the loosening of bolts 56 and sliding feet 50, 52 upwardly and downwardly within slots 49. Depending upon the length of the feet and the angle between pad 51 and flange 54 of each of the legs, a vertical adjustment of at least 4" can be provided to provide a micro adjustment of the work surface 12. The foot is designed so that it provides stability to the table and it can be adjusted in the lower leg T-slot to achieve 4" of adjustment between the lower edge of each of the legs 50, 52 and the vertically extending side edges 43, 44 of outer legs 40. In one embodiment, angle $\alpha$ was approximately 45°, although angles from 30° to 60° will also provide a desired micro height adjustment. The feet 50, 52 should be designed to provide support for a given work surface size and can be made of cast aluminum having relief apertures 58 therein or stamped or otherwise formed of a suitable material, including a polymeric material, to provide the desired strength and stability for the table assembly 10.

Figure 16:
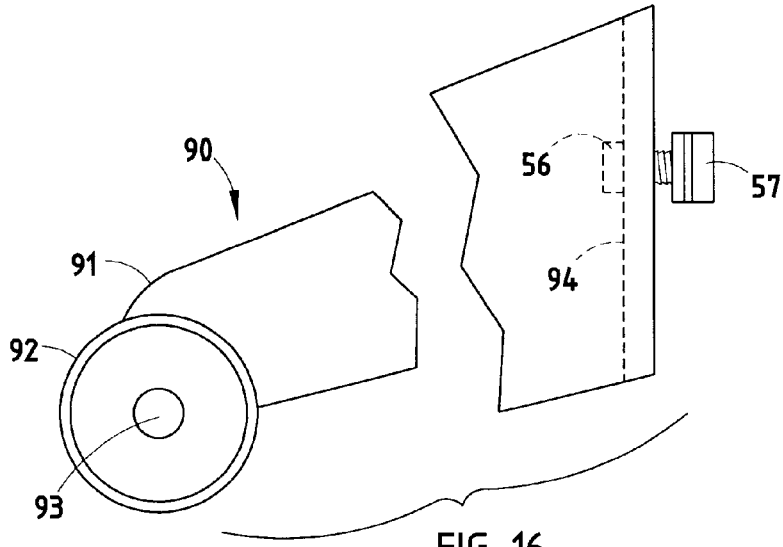
FIG. 16 is a side elevational view, partly broken-away in phantom form, of an alternative foot assembly for use in connection with the table assembly of the present invention.

In place of pads 51 on the feet 50, 52 for the table, one of the pairs (either 50 or 52) may include a roller foot assembly 90, such as shown in FIG. 16. Roller foot assembly 90 includes a caster 92 on one end of the leg section 91 which includes a mounting flange 94 for receiving a fastening bolt, such as a bolt 56 similar to the attachment of feet 50 and 52 as shown in FIGS. 14 and 15, for coupling to a T-nut 57, which fits within slots 49 of one side of outer leg 40. The roller foot assembly 90, including a caster 92 rotatably mounted to leg section 91 by means of an axle 93, permits the table assembly 10 to be raised at one edge and easily moved along the floor to different locations.

Figure 7:
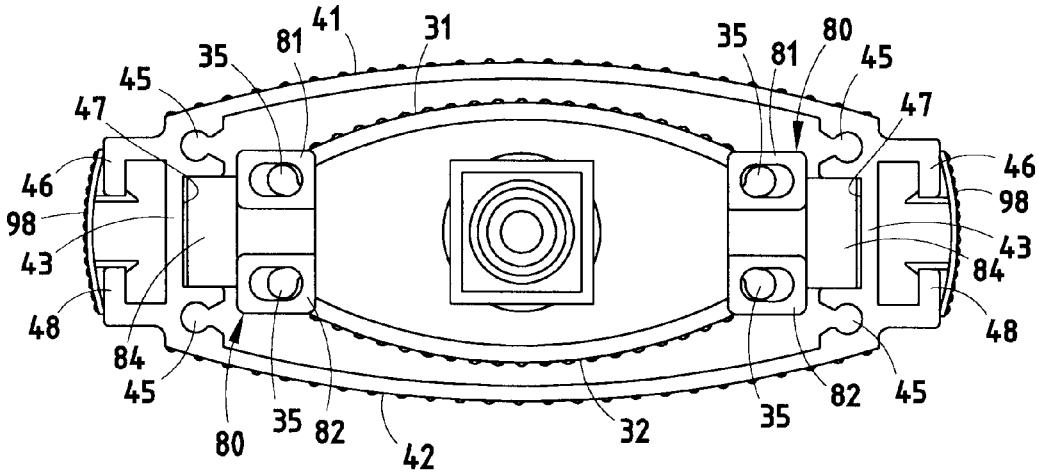
FIG. 7 is a cross-sectional view of the interface between the upper and lower legs taken along section lines VII—VII of FIG. 6.
Figure 17:
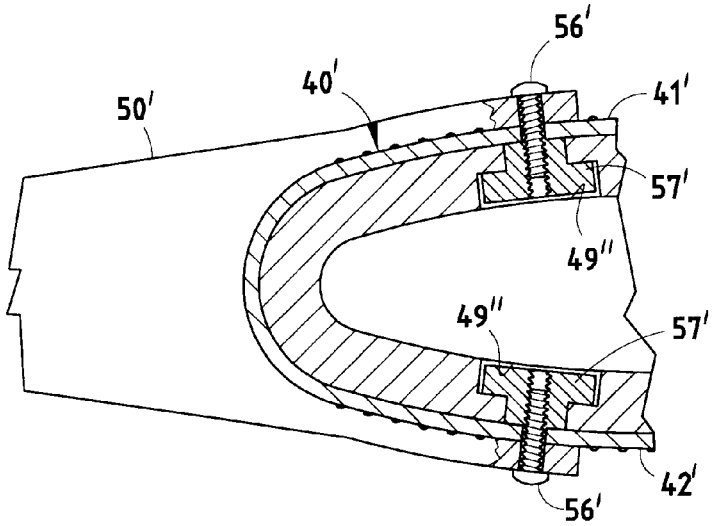
FIG. 17 is a fragmentary vertical cross-sectional view of an alternate mounting system for the feet of the table assembly of the present invention.

Instead of having T-shaped slots 49 on the end walls 43, 44 of outer leg 40, an outer leg 40' (FIG. 17) may include an extrusion including T-shaped slots 49' and 49" formed in the side walls 41' and 42' as opposed to having a single T-shaped slot in each of the end walls. Thus, extrusion of outer leg 40' would include four T-shaped slots, a pair on each of the opposite sides to allow a leg assembly, such as foot 50' to be attached to opposite sides of the leg 40" by means of attachment screws 56' extending into T-shaped nuts 57' in each of the slots 49". Such an arrangement provides a somewhat stronger connection which may, in some embodiments, be desirable. The open tracks 49, 49' and 49" of the outer leg 40 in each embodiment may be capped by a decorative extruded polymeric cap, such as cap 98 as seen in FIGS. 6 and 7, in those areas which do not include the stretcher 25 or the feet 50, 52.

Thus, with the table assembly of the present invention, macro adjustment is provided by the telescopic mounting of inner leg 30 to outer leg 40 by the power screw 18 and micro adjustment is provided by the adjustment of feet 50, 52 within the T-shaped slot 49 in the outer legs 40. Such an arrangement allows the table to provide a greater height adjustments well as adjusting the table for different stature individuals which will provide a comfortable work surface height for sitting and standing for different individuals.

It will become apparent to those skilled in the art that the exact extruded shape of the inner and outer legs can be varied as desired, as can be the shape and configuration of the support feet, as long as the inner and outer legs or intermediate or other telescopic leg assemblies provide a macro adjustment of the table surface while the feet are adjustably mounted to elongated tracks within the outer legs to provide a micro adjustment of the table height. These and other modifications to the preferred embodiment of the invention as described herein can be made without departing from the spirit or scope of the invention as defined by the appended claims.

The invention claimed is:

1. An adjustable height table comprising:

a work surface;

at least one telescopic leg with a first end coupled to said work surface and an opposite end;

at least one generally vertically extending elongated track formed on said telescopic leg near said opposite end for receiving a foot;

at least one foot;

a guide member extending into said track for movement therealong; and a fixing member for securing said foot to said guide member and to said telescopic leg in a selected position within said track.

2. The table as defined in claim 1 wherein said telescopic leg includes an inner leg and an outer leg slidably coupled together.

3. The table as defined in claim 2 and further including a motorized screw jack assembly coupling said inner and outer legs.

4. The table as defined in claim 3 wherein said elongated track extends along said outer leg.

5. The table as defined in claim 4 wherein said elongated track is generally T-shaped in cross-section and said guide member is T-shaped to slidably move within said track.

6. The table as defined in claim 5 wherein said guide member comprises a T-shaped threaded nut and said fixing member comprises a threaded fastener.

7. The table as defined in claim 1 wherein said foot includes a floor engaging pad at one end, an upwardly extending leg, and a mounting flange extending from an end of said upwardly extending leg opposite said pad for engaging said opposite end of said telescopic leg.

8. The table as defined in claim 7 wherein said telescopic leg includes a pair of elongated tracks on opposite sides thereof and said table includes a pair of feet and associated guide members and fixing members for adjustably mounting said feet to said tracks in said telescopic leg.

9. The table as defined in claim 7 wherein said telescopic leg includes an inner leg and an outer leg slidably coupled together.

10. The table as defined in claim 9 and further including a motorized screw jack assembly coupling said inner and outer legs.

11. The table as defined in claim 10 wherein said elongated tracks extend along said outer leg.

12. The table as defined in claim 11 wherein said elongated tracks are generally T-shaped in cross-section and said guide members are T-shaped to slidably move within said tracks.

13. The table as defined in claim 12 wherein said guide members comprise T-shaped threaded nuts and said fixing members comprise threaded fasteners.

14. An adjustable table assembly comprising:

a table top defining a work surface;

a pair of telescopically adjustable legs coupled to said work surface for providing macro height adjustment of said work surface, each of said legs including opposed vertically extending slots; and a pair of feet adjustably coupled in sliding relationship in said slots of each of said adjustable legs to provide micro adjustment of said work surface.

15. An adjustable table assembly comprising:

a table top defining a work surface;

a pair of telescopic legs coupled to said work surface, each leg including an inner and an outer leg movably mounted with respect to one another and powered by an electric motor coupled to a screw jack assembly for extending and retracting said inner and outer legs with respect to one another; wherein said outer legs include at least a pair of elongated T-shaped slots; and a pair of feet associated with each of said outer legs, said feet including a mounting flange for adjustably coupling one end of said feet to said elongated slots of said outer leg to provide a vertical adjustment of said work surface, each of said feet including foot pad at an end of each of said feet opposite said mounting flange for engaging a support surface.

16. The table assembly defined in claim 15 and further including a T-shaped nut fitted within said tracks of said outer leg, wherein said mounting flange receives a fastener which extends into said T-shaped nuts for adjustably securing each of said feet in a desired, vertically adjusted position with respect to said outer leg.

17. An adjustable table assembly comprising:

a table top defining a work surface;

a pair of telescopic legs coupled to said work surface, each leg including an inner and an outer leg movably mounted with respect to one another and powered by an electric motor coupled to a screw jack assembly for extending and retracting said inner and outer legs with respect to one another; wherein said outer legs include at least a pair of elongated T-shaped slots; and a pair of feet associated with each of said outer legs, said feet including a mounting flange for adjustably coupling one end of said feet to said elongated slots of said outer leg to provide a relatively small vertical adjustment of said work surface and wherein one of said feet includes a foot pad at an opposite end of said flange and another of said feet includes a caster at an opposite end of said flange for engaging a support surface to allow the table assembly to be rolled from one work area to another.

18. A telescopic leg assembly comprising:

an inner and an outer leg, wherein said outer leg is defined by an extrusion having inner opposed facing guide channels and said inner leg includes a pair of lubricious polymeric guide blocks including an extension slidably fitting within said opposed facing guide channels of said outer leg, wherein said guide blocks include elongated apertures for receiving fasteners adjustably securing said guide blocks to said inner leg.

19. The leg assembly as defined in claim 18 and further including a bezel extending between an end of said outer leg and said inner leg to provide interface support between said inner and outer legs at said end of said outer leg.

20. The leg assembly as defined in claim 19 and further including a screw jack assembly coupled between said inner and outer legs for extending and retracting said legs with respect to one another.

21. A telescopic leg assembly comprising:

an inner and an outer leg, wherein said outer leg is defined by an extrusion having inner opposed facing guide channels and said inner leg includes a pair of lubricious polymeric guide blocks including an extension adjustably mounted to said inner leg for slidably fitting within said opposed facing guide channels of said outer leg;

a bezel extending between an end of said outer leg and said inner leg to provide interface support between said inner and outer legs at said end of said outer leg; and a screw jack assembly coupled between said inner and outer legs for extending and retracting said legs with respect to one another, wherein said outer leg includes a pair of guide tracks on opposed outer surfaces thereof for adjustably receiving feet for said leg assembly.

22. The leg assembly as defined in claim 21 and further including a pair of feet each foot having a mounting flange for attaching said feet to said tracks of said outer leg.

23. The leg assembly as defined in claim 22 wherein at least one of said feet includes a surface engaging pad.

24. The leg assembly as defined in claim 23 wherein at least another of said feet includes a caster wheel for engaging a support surface.

* * * * *